United States Patent [19]

Houriez et al.

[11] 3,972,378

[45] Aug. 3, 1976

[54] SWING LOCK MEANS FOR AN HYDRAULIC EXCAVATOR

[75] Inventors: Gérard P. A. J. Houriez, Gerpinnes; Charles M. G. Van Wuytswinkfl, Thimeon, both of Belgium

[73] Assignee: Caterpillar Tractor Co., Peoria, Ill.

[22] Filed: Jan. 23, 1975

[21] Appl. No.: 543,572

[52] U.S. Cl. ..... 180/6.58; 180/77 S; 180/89 R

[51] Int. Cl.[2] ..... B62D 27/06

[58] Field of Search ..... 180/89 R, 77 S, 6.58, 180/6.6; 74/421 A

[56] References Cited

UNITED STATES PATENTS

| | | | |
|---|---|---|---|
| 1,836,056 | 12/1931 | Wright | 180/6.58 |
| 1,940,690 | 12/1933 | Moore | 180/6.58 |
| 2,281,288 | 4/1942 | Hettelsater | 180/6.58 |
| 3,347,558 | 10/1967 | Grims | 180/77 S |
| 3,568,778 | 3/1971 | Swisher | 180/77 S X |

*Primary Examiner*—M. H. Wood, Jr.
*Assistant Examiner*—Terrance L. Siemens
*Attorney, Agent, or Firm*—Phillips, Moore, Weissenberger Lempio & Strabala

[57] ABSTRACT

An excavator comprises an upper unit rotatably mounted on a tracked undercarriage. A swing gear mechanism is operatively connected between the upper unit and the undercarriage to selectively rotate the upper unit. An operator-controlled locking mechanism is positioned interiorly of the swing gear mechanism to selectively lock the upper unit relative to the undercarriage.

15 Claims, 5 Drawing Figures

SWING LOCK MEANS FOR AN HYDRAULIC EXCAVATOR

BACKGROUND OF THE INVENTION

Hydraulic excavators comprise an upper unit rotatably mounted on a tracked undercarriage or car body for selectively positioning a work implement during excavator operation. A lock pin, mounted exteriorly of a swing gear mechanism for selectively rotating the upper unit, is normally mounted on the upper unit to engage the undercarriage to lock the upper unit in position, particularly during transport of the excavator to a remote job site. The pin is thus exposed to damage and must be actuated manually.

SUMMARY OF THE INVENTION

An object of this invention is to provide an improved swing lock means for an earthworking vehicle, such as an excavator, adapted to selectively lock a rotatable upper unit relative to a tracked undercarriage thereof. The lock means is disposed interiorly of a swing gear mechanism operatively connected between the upper unit and the undercarriage to selectively rotate the upper unit thereon. An operator control means mounted in an operator's cab of the upper unit, is operatively connected to the lock means to selectively actuate the same between its unlocked and locked positions.

BRIEF DESCRIPTION OF THE DRAWINGS

Other objects of this invention will become apparent from the following description and accompanying drawings, wherein.

DETAILED DESCRIPTION

Figure 1:
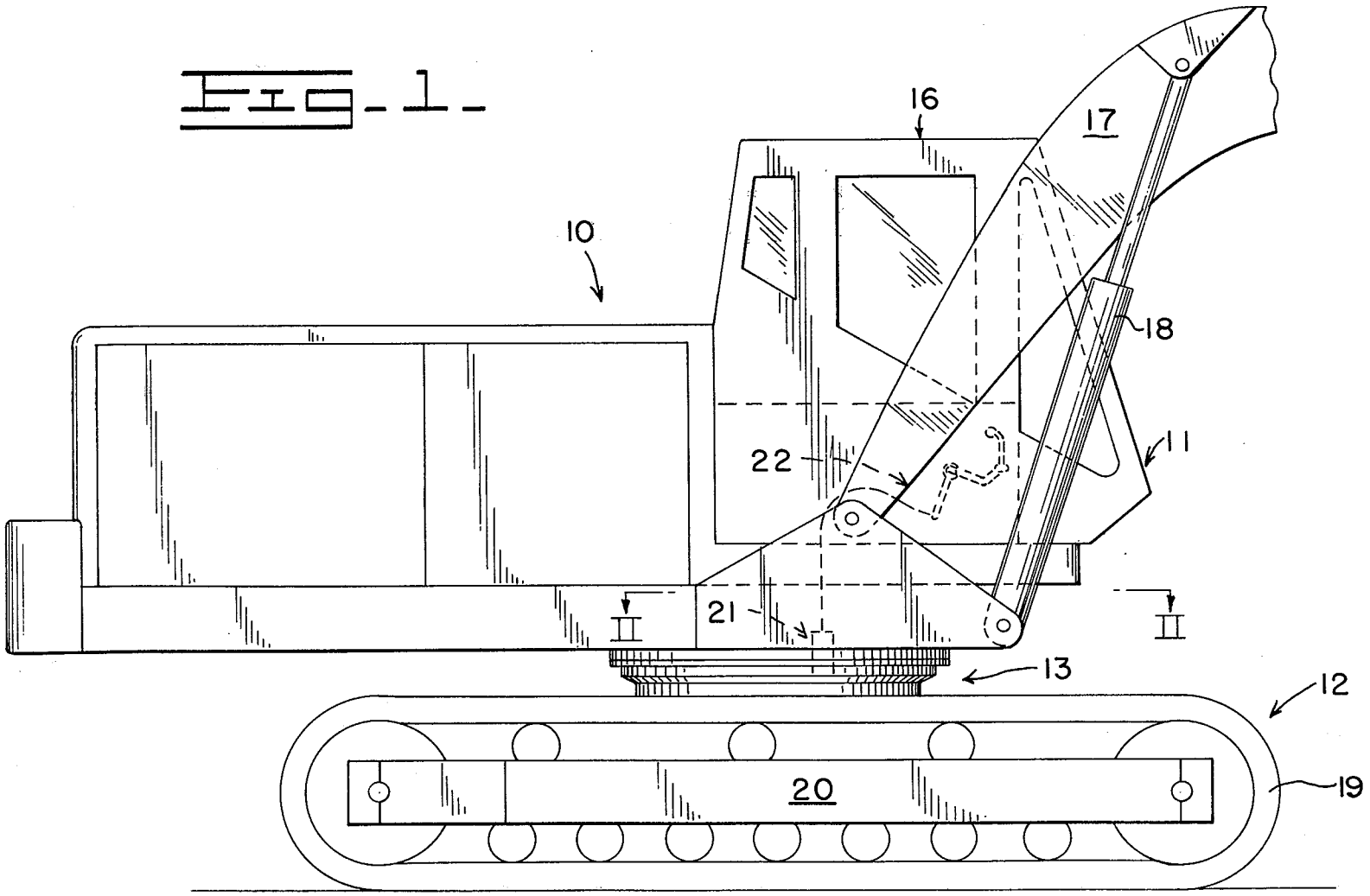
FIG. 1 is a partial side elevational view of a hydraulic excavator employing the swing lock means of this invention therein.

FIG. 1 illustrates a hydraulic excavator 10 comprising an upper unit 11 rotatably mounted on a tracked undercarriage 12 by a swing gear mechanism 13. Such swing gear mechanism may be of the type disclosed in U.S. Pat. No. 3,739,652, assigned to the assignee of this application, and essentially comprises a ring gear 14 secured to the undercarriage and a swing or pinion gear 15 meshing with the ring gear for selectively rotating the upper unit (FIG. 2).

The upper unit further comprises an enclosed operator's cab 16 and a boom 17 movably mounted on the upper unit by a pair of double-acting hydraulic cylinders 18 (one shown). The mobile undercarriage comprises a pair of laterally spaced endless tracks 19 (one shown) each mounted on a track roller frame 20. When the excavator is transported to a remote job site, for example, a lock means 21 of this invention is adapted to be selectively actuated by an operator control means

22, mounted in cab 16, to lock the upper unit relative to an intermediate frame or carbody 23 secured laterally between frames 20.

Figure 2:
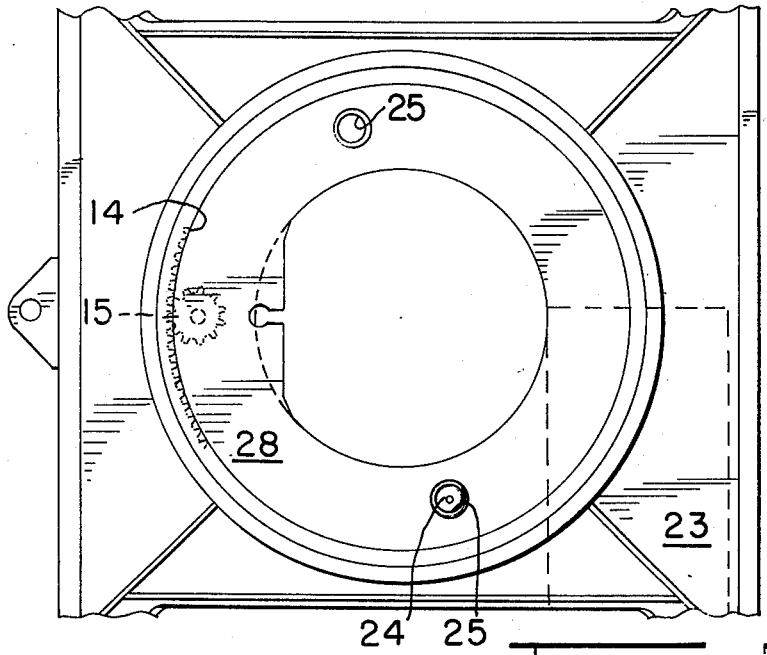
FIG. 2 is an enlarged top elevational view of the swing lock means taken in the direction of arrows II—II in FIG. 1.
Figure 3:
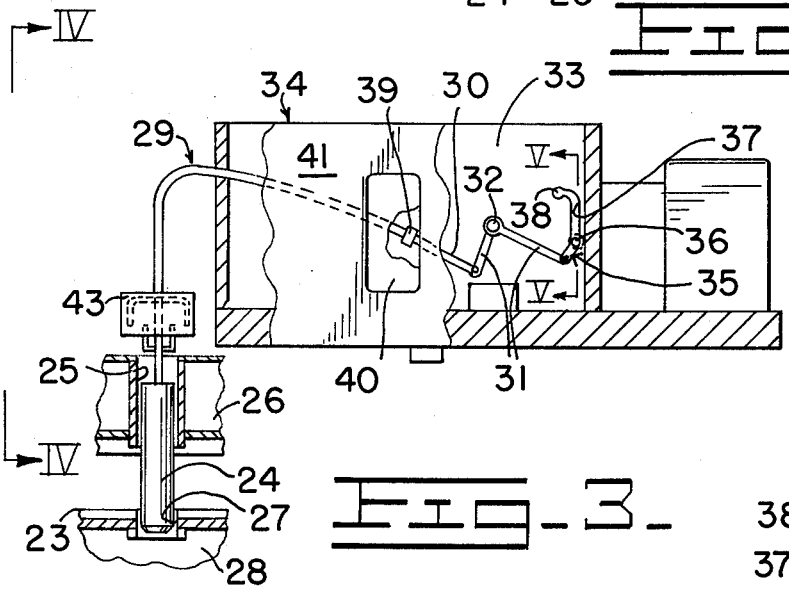
FIG. 3 is a sectioned side elevational view of the swing lock means and an operator control means therefor.

Referring to FIGS. 2–3, the lock means is disposed within the confines of the swing gear mechanism and comprises a pin 24 reciprocally mounted in a tubular bore 25 formed vertically through a support member 26 forming an integral part of the frame structure of the upper unit. In its locked position, the lower end of the pin engages one of two diametrically opposed apertures 27 formed in a cover 28 secured to the underside of ring gear 14 as an integral part of frame 23. The two-position lock means permits boom 17 to be positioned either at the aft or fore end of the excavator.

Operator control means 22 comprises a sheathed cable 29 having a first end of its internal control wire 30 (FIG. 4) secured to a top end of pin 24 and a second end thereof pivotally attached to a first arm of a bellcrank 31. The bellcrank is pivotally mounted on a pivot pin 32, secured to a first sidewall 33 of a control panel 34. A handle 35 is pivotally mounted on a second arm of the bellcrank and has a guide pin 36 secured thereon.

Figure 5:
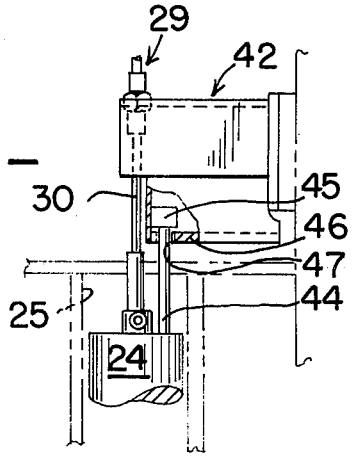
FIG. 5 is an enlarged sectional view taken in the direction of arrows V—V in FIG. 3.

A vertically disposed guide means or slot 37 is formed in sidewall 33 of the control panel and has pin 36 slidably mounted therein (FIG. 5). The vertically disposed slot terminates at its upper end at a horizontally disposed notch portion 38 adapted to hold pin 36 thereat to lock pin 24 in its raised, unlocked position. The outer sheath of cable 29 is secured to sidewall 33 by a bracket 39 accessible via a removable panel 40 provided on a second sidewall 41.

Figure 4:
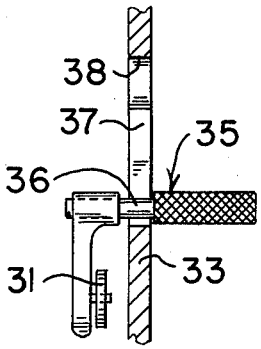
FIG. 4 is an enlarged end elevational view of the lock means taken in the direction of arrows IV—IV in FIG. 3.

The outer sheath of cable 29 is further secured to a block 42 which is, in turn, secured to a rail 43 forming an integral part of the framework of upper unit 11. As shown in FIG. 4, control wire 30 of cable 29 is secured to an upper end of pin 24 along with a vertically disposed guide pin 44. A stop means 45 is secured on the upper end of pin 44 to limit the vertical downward movement of pin 24 by its engagement with a lower wall or support member 46 of block 42. Pin 44 projects through a like-shaped guide opening 47 formed through wall 46 to provide guide means precisely controlling reciprocal movements of pin 24 into accurate alignment with one of the two apertures 27. Pin 44 also prevents rotation of pin 24 which could damage the cable 29. If cable 29 is broken, pin 44 prevents pin 24 from falling completely through either of apertures 27.

We claim:

1. An earthworking vehicle comprising a mobile undercarriage, an upper unit rotatably mounted on said undercarriage, an operator's cab mounted on said upper unit, a swing gear drive mechanism operatively connected between said upper unit and said undercarriage for selectively rotating said upper unit, lock means operatively connectable between said upper unit and said undercarriage for selectively locking said upper unit against rotation relative to said undercarriage, said lock means disposed within the confines of said swing gear drive mechanism, and operator control means mounted in said operator's cab and operatively connected to said lock means for selectively locking said upper unit to said undercarriage, said operator control means comprising a handle movably mounted on a support in said operator's cab and guide means formed on said support for guiding said handle between locked and unlocked positions thereof, said handle being operatively connected to said lock means by a bellcrank pivotally mounted on said support and having one arm thereof pivotally connected to said handle and a cable interconnected between a second arm of said bellcrank and said lock means.

2. The vehicle of claim 1 wherein said undercarriage comprises a pair of laterally spaced track roller frames and an intermediate frame attached between said track roller frames, and wherein said swing gear drive mechanism comprises a ring gear secured to said intermediate frame and a pinion gear meshing with said ring gear.

3. The vehicle of claim 1 wherein said lock means comprises a lock pin reciprocally mounted on said upper unit between locked and unlocked positions thereof and an aperture defined on said undercarriage to underlie said lock pin.

4. The vehicle of claim 3 wherein a pair of said apertures are defined on said undercarriage.

5. The vehicle of claim 4 wherein said apertures are diametrically opposed on said undercarriage.

6. The vehicle of claim 3 wherein said lock pin is reciprocally mounted in a tubular bore defined in said upper unit.

7. The vehicle of claim 6 further comprising guide means operatively connected to said lock pin for guiding vertical movements thereof between its locked and unlocked positions.

8. The vehicle of claim 7 wherein said guide means comprises a guide pin secured to said lock pin, said guide pin being disposed for reciprocal movements in a like-shaped guide opening formed in a support member mounted adjacent to said lock pin.

9. The vehicle of claim 8 further comprising stop means secured on said guide pin and positioned thereon to engage said support member to limit downward vertical movement of said lock pin to its locked position.

10. The vehicle of claim 1 wherein said guide means comprises an at least generally vertically disposed guide slot and a pin secured to said handle and disposed in said slot.

11. The vehicle of claim 10 wherein said guide slot terminates at its upper end on an at least generally horizontally disposed notch portion defining the unlocked position of said handle.

12. An earthworking vehicle comprising a mobile undercarriage, an upper unit rotatably mounted on said undercarriage, an operator's cab mounted on said upper unit, a swing gear drive mechanism operatively connected between said upper unit and said undercarriage for selectively rotating said upper unit, lock means operatively connectable between said upper unit and said undercarriage for selectively locking said upper unit against rotation relative to said undercarriage, said lock means disposed within the confines of said swing gear drive mechanism and comprising a lock pin reciprocally mounted in a tubular bore defined in said upper unit for movement between locked and unlocked positions thereof and an aperture defined on said undercarriage to underlie and receive said lock pin when said pin is moved to its locked position therein, operator control means mounted in said operator's cab and operatively connected to said lock pin for selectively moving the same to lock said upper unit to said undercarriage, and guide means operatively connected to said lock pin for guiding vertical movements thereof between its locked and unlocked positions comprising a guide pin secured to said lock pin and disposed for reciprocal movements in a like-shaped guide opening formed in a support member mounted adjacent to said lock pin.

13. The vehicle of claim 12 further comprising stop means secured on said guide pin and positioned thereon to engage said support member to limit downward vertical movement of said lock pin to its locked position.

14. An earthworking vehicle comprising a mobile undercarriage, an upper unit rotatably mounted on said undercarriage, an operator's cab mounted on said upper unit, a swing gear drive mechanism operatively connected between said upper unit and said undercarriage for selectively rotating said upper unit, lock means operatively connectable between said upper unit and said undercarriage for selectively locking said upper unit against rotation relative to said undercarriage, said lock means disposed within the confines of said swing gear drive mechanism, and operator control means mounted in said operator's cab and operatively connected to said lock means for selectively locking said upper unit to said undercarriage, said operator control means comprising a handle movably mounted on a support in said operator's cab and guide means formed on said support for guiding said handle between locked and unlocked positions thereof, said guide means comprising an at least generally vertically disposed guide slot and a pin secured to said handle and disposed in said slot.

15. The vehicle of claim 14 wherein said guide slot terminates at its upper end on an at least generally horizontally disposed notch portion defining the unlocked position of said handle.

* * * * *

UNITED STATES PATENT AND TRADEMARK OFFICE

CERTIFICATE OF CORRECTION

PATENT NO. : 3,972,378

DATED : August 3, 1976

INVENTOR(S) : G.P.A.J. Houriez and G.M.G. Van Wuytswinkel

It is certified that error appears in the above-identified patent and that said Letters Patent are hereby corrected as shown below:

The title of this patent, shown on the title page at section [54] and at the top of Col. 1, should be:

"SWING LOCK MEANS FOR AN EXCAVATOR"

The second inventor shown on the title page at section [75] should be:

Charles M.G. Van Wuytswinkel

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*